US006647216B2

(12) United States Patent
Tanaka

(10) Patent No.: US 6,647,216 B2
(45) Date of Patent: Nov. 11, 2003

(54) IMAGE FORMING APPARATUS

(75) Inventor: Noriaki Tanaka, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/086,719

(22) Filed: Mar. 4, 2002

(65) Prior Publication Data

US 2002/0127022 A1 Sep. 12, 2002

(30) Foreign Application Priority Data

Mar. 7, 2001 (JP) ..... 2001-063194

(51) Int. Cl.[7] ..... G03G 15/20
(52) U.S. Cl. ..... 399/21; 399/124; 399/320
(58) Field of Search ..... 399/16, 21, 67, 399/124, 320, 322, 328

(56) References Cited

U.S. PATENT DOCUMENTS 4,684,235 A * 8/1987 Kohmoto et al. ..... 355/21 X
5,099,289 A * 3/1992 Kurotori et al. ..... 399/320
5,182,595 A * 1/1993 Fukuchi et al. ..... 399/21
5,365,322 A * 11/1994 Hamada et al. ..... 399/21
6,253,046 B1 * 6/2001 Horrall et al. ..... 399/124

FOREIGN PATENT DOCUMENTS

JP 11-296017 * 10/1999

* cited by examiner

*Primary Examiner*—Sophia S. Chen
(74) *Attorney, Agent, or Firm*—Fitzpatrick, Cella, Harper & Scinto

(57) ABSTRACT

An image forming apparatus includes: a fixing device having a nip portion in which a recording material having an unfixed image is nipped and conveyed and the unfixed image is fixed to the recording material; a pressure applying device for applying a pressure to the nip portion; a pressure release device for releasing the pressure in the nip portion; and a detection device for detecting a presence or absence of the recording material. When the pressure in the nip portion is released by the pressure release device, the detection device outputs a detection result representing the presence of the recording material. The pressure release device have a plurality of levers for releasing the pressure and the levers are arranged at both ends of the fixing device in a direction perpendicular to a moving direction of the recording material.

3 Claims, 9 Drawing Sheets

IMAGE FORMING APPARATUS

BACKGROUND OF THE INVENTION

1. Field of the Invention

The present invention relates to an image forming apparatus such as a copying machine, a printer, and a facsimile and in particular to an image forming apparatus having a fixing device for fixing an image onto a recording material.

2. Description of Related Art

In an electrophotographic image forming apparatus, a recording sheet having a toner image passes through a nip portion consisting of a heating unit and a pressure roller unit while the toner image is fixed onto the recording sheet. When the recording sheet remains in the nip portion, i.e., when a sheet jam is caused in the nip portion and jam clearance is tried, the jamming sheet cannot be pulled out because of the pressure of the nip portion.

For this, conventionally, a pressure release mechanism has been used to release the pressure of the fixing nip portion for facilitating jam clearance when jam has occurred.

However, in a fixing device having the pressure release mechanism, when a printer main body is operated with the fixing nip portion in a pressure released state, the toner image is not sufficiently fixed to the recording sheet, which causes contamination of the heating unit, a pressure roller unit, a conveying roller, and the like by an unfixed toner image. Moreover, in case of a heating unit using a ceramic heater, when the main body is operated with the pressure of the nip portion in a pressure released state, the heater may be damaged.

To solve such a problem, Japanese Patent Application Laid-Open No. 11-296017 discloses a technique as follows.

The technique uses a pressure release detection mechanism interlocked with the release operation of the fixing roller and a pressure roller. When a pressure release lever of the pressure release mechanism which is disposed on one side of the fixing device is moved to a pressure release direction, a cam member fixed to a rotation shaft which rotates together with the pressure release lever presses the pressure roller downward against a spring force of a compression spring, thereby releasing the pressure of the fixing roller and the pressure roller. Moreover, the rotation shaft extends almost over the entire length of the pressure roller. As the rotation shaft rotates, a protrusion provided on the rotation shaft rotates a sheet discharge sensor. This rotation of the sheet discharge sensor is transferred to a photo-interrupter arranged outside of the pressure roller to block the light path, thereby detecting the pressure release state.

The aforementioned conventional example is advantageous for pressure release detection but can be improved in the following points.

That is, in the conventional example, as has been described above, the pressure release lever arranged on only one side is operated. When the pressure release lever is operated and release operation is performed at both ends, the rotation shaft should be provided over the entire length of the roller and accordingly, the rotation shaft should have sufficient rigidity enabling release of the pressure and need be made from an expensive material.

Moreover, since the photo-interrupter is arranged outside the pressure roller and the protrusion for detecting a recording sheet of the discharge sensor unit is at a distance from the photo-interrupter, there is a problem that the discharge sensor unit becomes larger and the entire apparatus becomes larger in size.

SUMMARY OF THE INVENTION

It is therefore an object of the present invention to provide an image forming apparatus that can maintain a non-operation state of the apparatus main body without using a high-rigid expensive shaft member upon a pressure release.

Another object of the present invention is to provide an image forming apparatus capable of reducing the apparatus size and can maintain the non-operation state of the apparatus main body upon a pressure release.

Yet another object of the present invention is to provide an image forming apparatus comprising: fixing means having a nip portion; pressure applying means for applying a pressure to the nip portion; pressure release means for releasing the pressure in the nip portion; and detection means for detecting a presence or absence of a recording material, wherein a recording material having an unfixed image is nipped and conveyed by the nip portion and the unfixed image is fixed to the recording material, when the pressure in the nip portion is released by the pressure release means, the detection means outputs a detection result indicating that a recording material is present, and the pressure release means have a plurality of levers for releasing the pressure and the levers are arranged at both ends of the fixing means in a direction perpendicular to a conveying direction of the recording material.

Still another object of the present invention is to provide an image forming apparatus comprising: fixing means having a nip portion; pressure applying means for applying a pressure to the nip portion; pressure release means for releasing the pressure in the nip portion; and detection means for detecting a presence or absence of a recording material, wherein a recording material having an unfixed image is nipped and conveyed by the nip portion and the unfixed image is fixed to the recording material, when the pressure in the nip portion is released by the pressure release means, the detection means outputs a detection result indicating that a recording material is present, and the detection means is arranged within a width of the fixing means in a direction perpendicular to a conveying direction of the recording material.

These and other objects of the present invention will become clear from the following description.

DETAILED DESCRIPTION OF THE PREFERRED EMBODIMENTS

Description will now be directed to the present invention with reference to the accompanying drawings.

Embodiment 1

Figure 1:
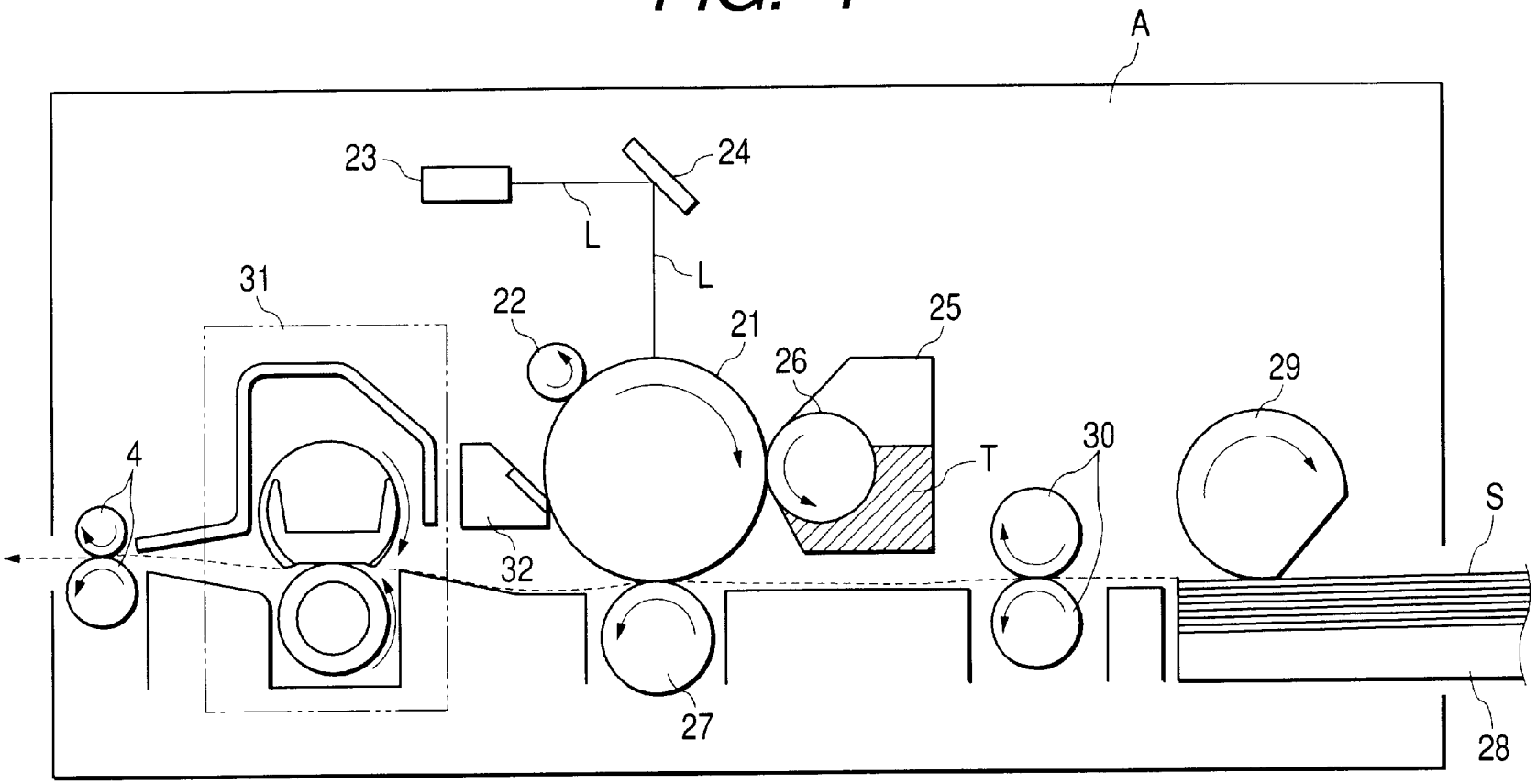
FIG. 1 schematically shows configuration of an image forming apparatus according to an embodiment of the present invention.
Figure 2:
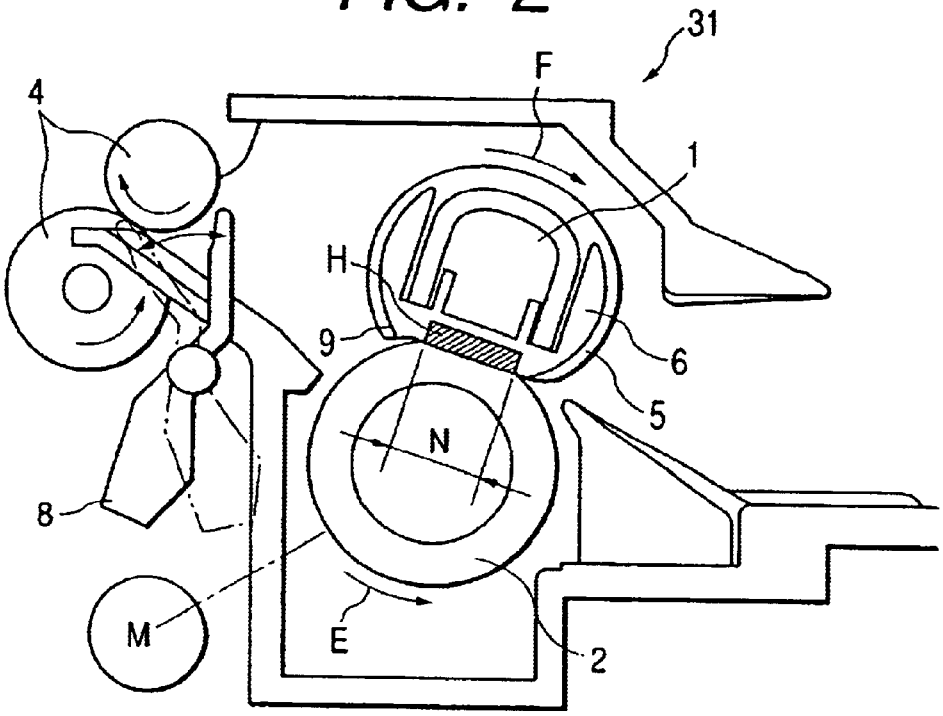
FIG. 2 is a schematic cross sectional view of a fixing device in the first embodiment of the present invention.
Figure 3:
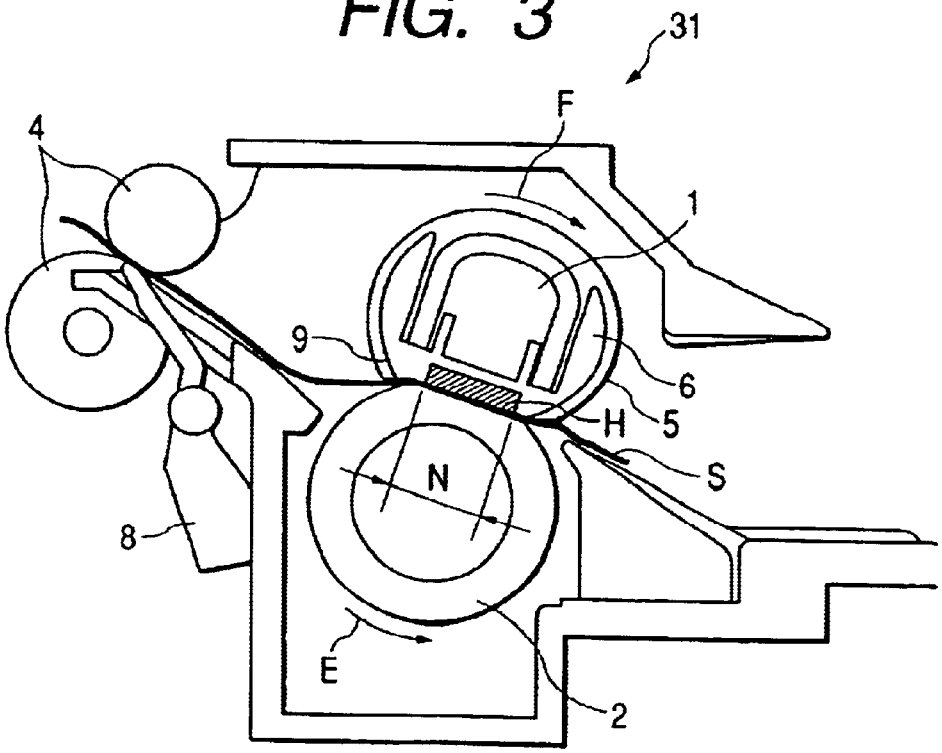
FIG. 3 shows a schematic cross sectional view when a jam occurs in the fixing device of FIG. 2.
Figure 4:
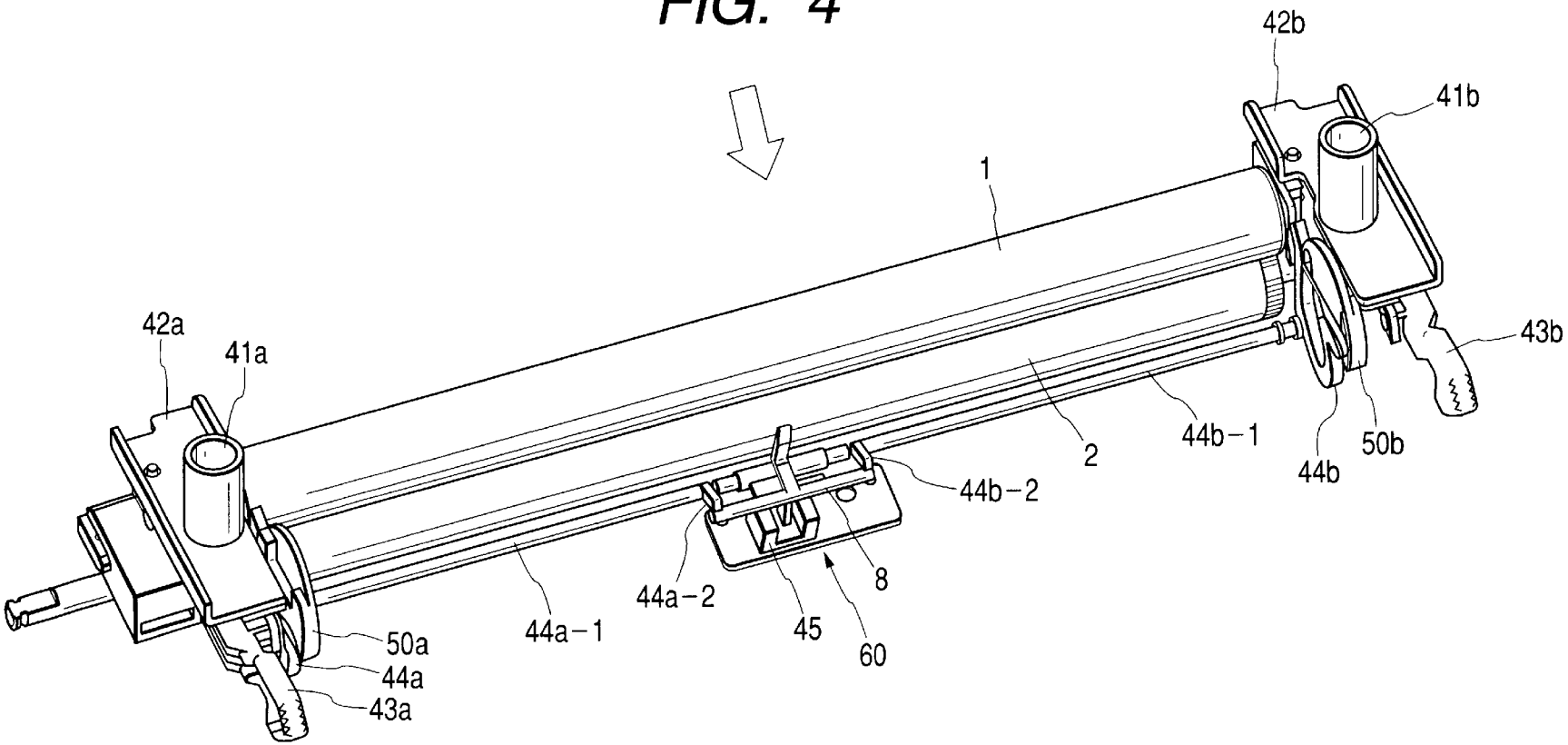
FIG. 4 is a perspective view of the fixing device when pressure is applied in the first embodiment.
Figure 5:
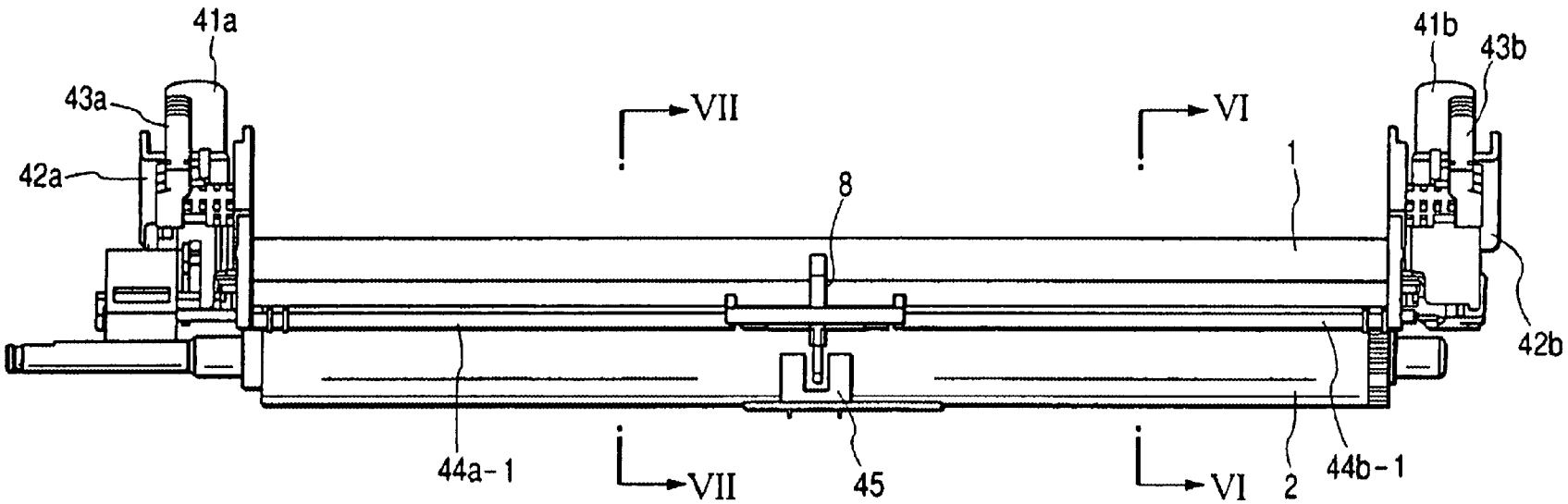
FIG. 5 is a front view of the fixing device of FIG. 1 viewed from the sheet discharge side.
Figure 6:
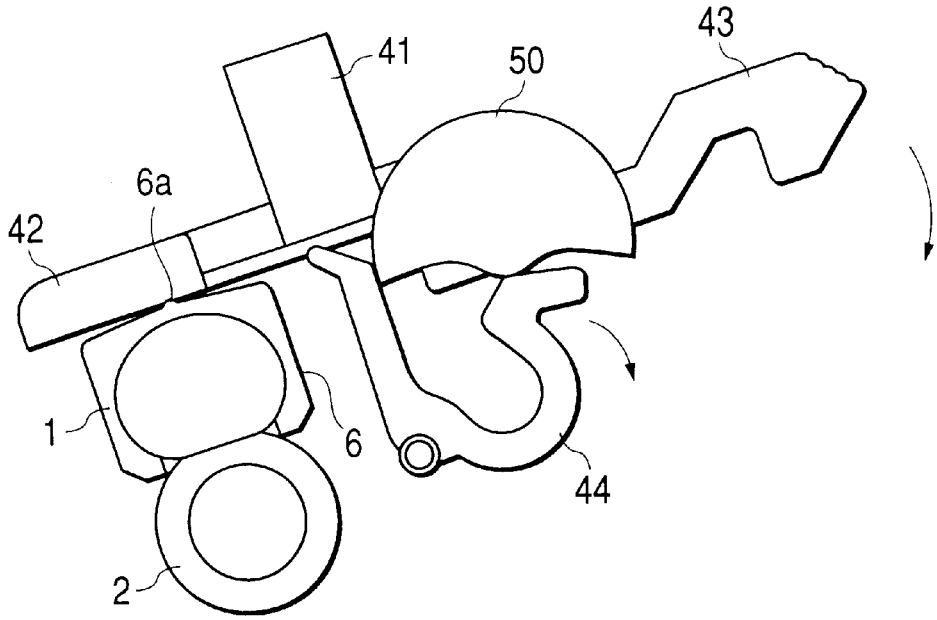
FIG. 6 is a cross sectional view taken on line VI—VI of FIG. 5.
Figure 7:
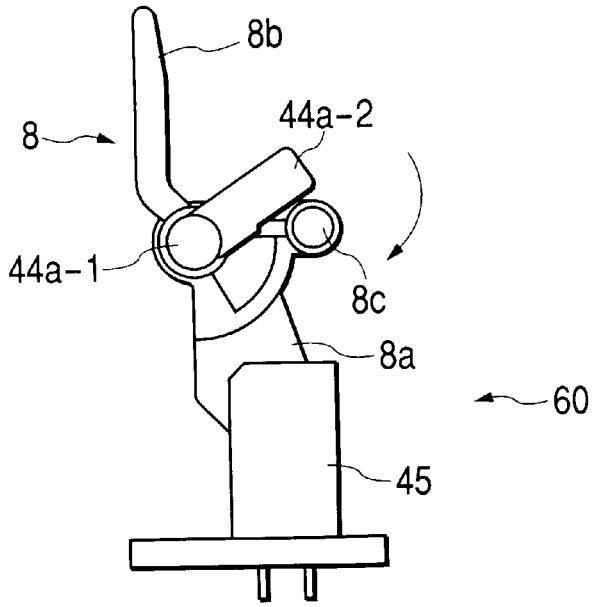
FIG. 7 is a cross sectional view taken on line VII—VII of FIG. 5.
Figure 8:
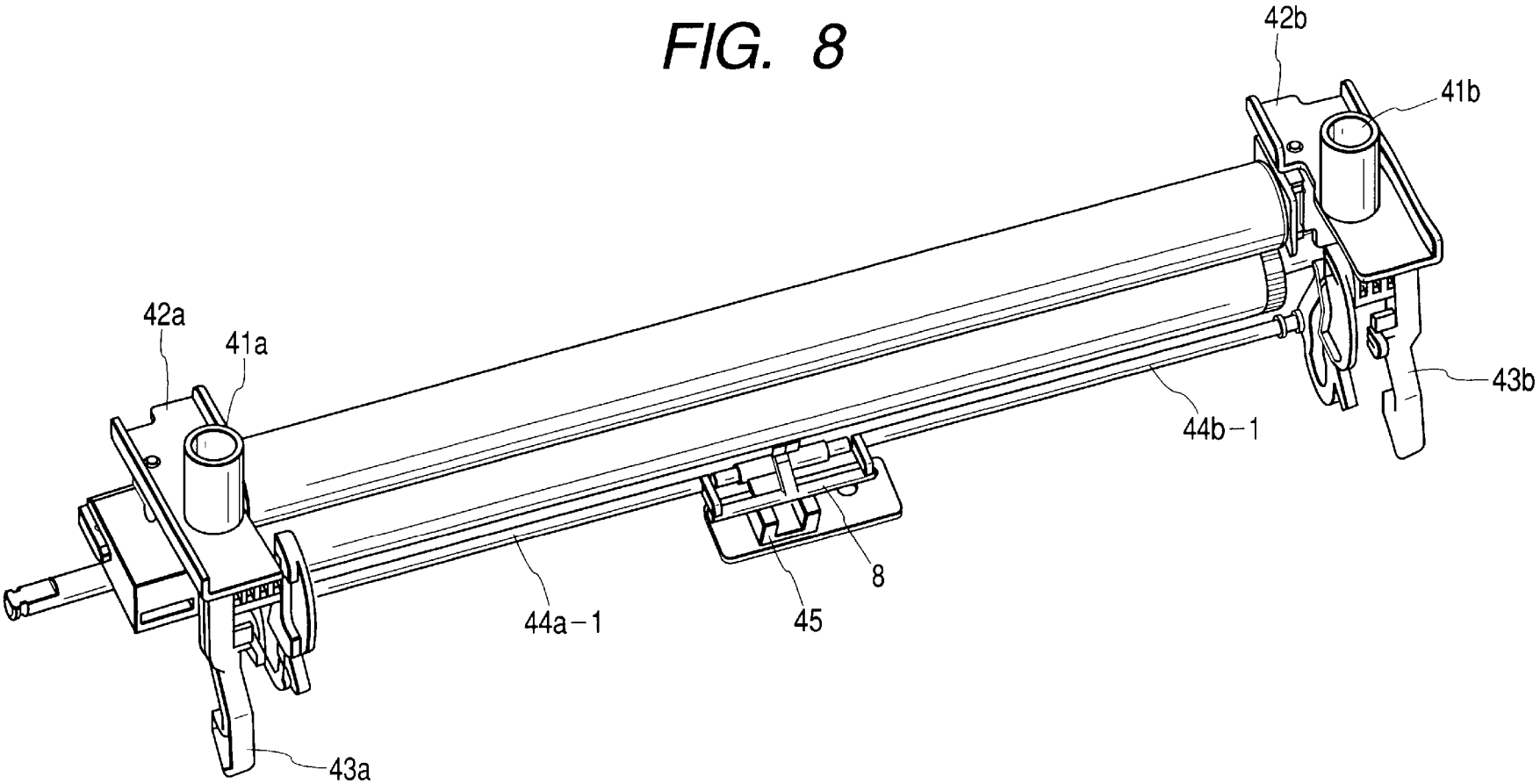
FIG. 8 is a perspective view of the fixing device when pressure is released in the first embodiment.
Figure 9:
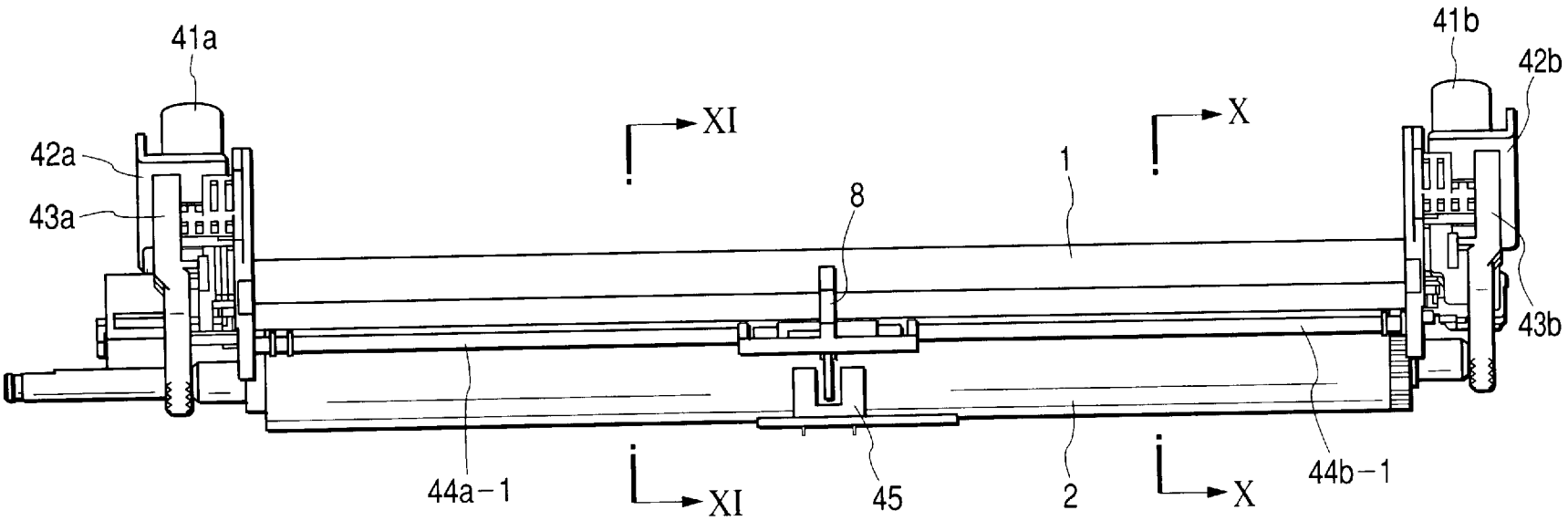
FIG. 9 is a front view of the fixing device of FIG. 8 as viewed from the sheet discharge side.
Figure 10:
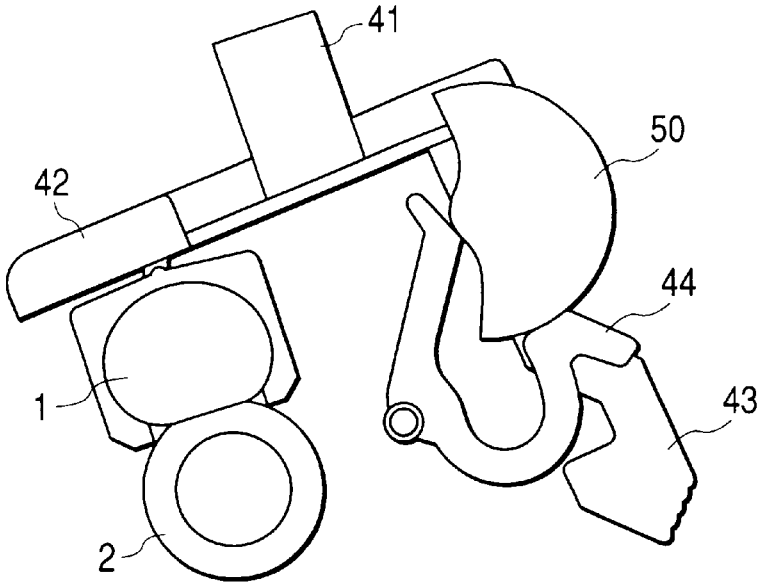
FIG. 10 a cross sectional view taken on line X—X of FIG. 9.
Figure 11:
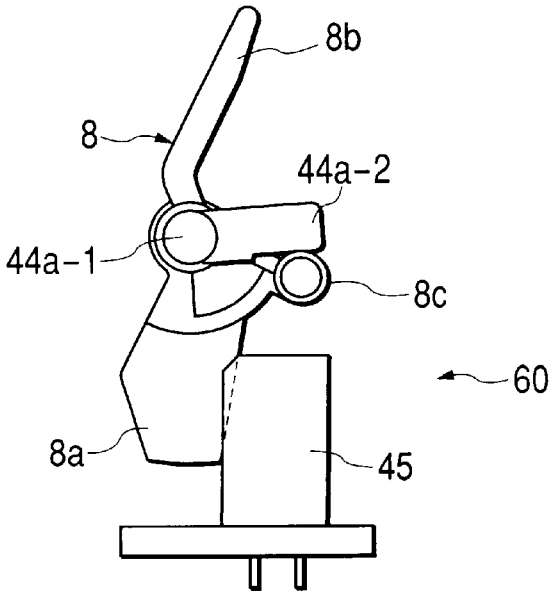
FIG. 11 a cross sectional view taken on line XI—XI of FIG. 9.

FIG. 1 schematically shows configuration of an image forming apparatus having a fixing device for fixing a toner image on a recording material according to an embodiment of the present invention. The image forming apparatus A of the embodiment is a laser printer using the transfer type electrophotographic process. FIG. 2 and FIG. 3 are schematic cross sectional views of the fixing device (FIG. 2 shows a state when the sheet discharge sensor is turned-OFF and FIG. 3 shows a state when the sheet discharge sensor is turned-ON). FIG. 4 to FIG. 7 show a state when pressure is applied and FIG. 8 to FIG. 11 show a state when pressure is released. It should be noted that FIG. 4 and FIG. 8 are internal perspective views of the fixing device; FIG. 5 and FIG. 9 are front views as viewed from the sheet discharge side. FIG. 6 is a cross sectional view taken on line VI—VI of FIG. 5; FIG. 7 is a cross sectional view taken on line VII—VII of FIG. 5; FIG. 10 is a cross sectional view taken on line X—X of FIG. 9; and FIG. 11 is a cross sectional view taken on line XI—XI of FIG. 9.

In FIG. 1, a drum-shaped electrophotographic photosensitive member (hereinafter, referred to as a photosensitive drum) 21 is driven to rotate at a predetermined peripheral speed in a clockwise direction indicated by the arrow. The photosensitive drum 21, while rotating, is subjected to a uniform charging of predetermined polarity and potential by charging roller 22 and then to a laser scan exposing light L corresponding to image information by a laser scanner 23 reflected off reflection mirror 24, and as a result, an electrostatic latent image corresponding to the image information is formed on its circumferential surface. The electrostatic latent image formed on the photosensitive drum 21 is developed as a toner image by a developing device 25. A reference numeral 26 denotes a developing roller and a reference sign T denotes toner in the developing device 25.

A transfer roller 27 is pressed against the photosensitive drum 21 so as to constitute the transfer nip portion. In a feed cassette 28, recording sheets (transfer material) S as a recording material are contained in a stacked state. When a feed roller 29 is driven, one of the recording sheets S is separated from the feed cassette 28 and fed by registration rollers 30 to the transfer nip portion at a predetermined timing and a toner image of the photosensitive drum 21 is successively transferred onto the recording sheet S. The recording sheet S, which has passed through the transfer nip portion, is stripped from the photosensitive drum 21, introduced into a fixing device 31 as fixing means and the toner image is subjected to a thermal fixing processing. Thereafter, the sheet S is discharged by sheet discharge rollers 4 out of the apparatus. Moreover, after the recording sheet is stripped, the photosensitive drum 21 cleaned by a cleaning device 32, so that remaining extraneous matter such as the untransferred toner is removed to clean the surface of the photosensitive drum 21. Thus, the photosensitive drum 21 is ready for repetition of image forming.

FIG. 2 is a schematic cross sectional view of the fixing device of the present embodiment.

In FIG. 2, a heating unit 1 includes: a flat heater (ceramic heater in the embodiment) H which causes heat when electric current is applied; a cylindrical heat-resistant thin film 5 which is in contact with the heater H; and a heater holding member 6 supporting the heater H and rotatably supporting the heat-resistant thin film 5. Moreover, a pressure roller unit 2 in pressure contact with the heating unit 1 so as to constitute a nip portion N is driven by a motor M (drive means) to rotate a counterclockwise direction indicated by the arrow E. This moves the heat-resistant thin film 5 in the direction indicated by the arrow F.

In the fixing device, the pressure roller 2 is rotatably supported by bearings (not shown) engaged with roller support members (not shown) provided at both ends of the pressure roller 2. An end portion of the heater H is engaged with an upper portion of the bearing and in turn an end portion of a heater holding member 6 is engaged on the end portion of the heater H. As shown in FIG. 6, pressure plates 42 (42*a*, 42*b*) as a lever member is mounted on a pressure portion 6*a* formed on the upper surface of the heater holding member 6. The pressure plate 42 has an end portion abutting against a lower end of a compression spring 41 (41*a*, 41*b*). The pressure plate 42 is rotated clockwise so as to apply a pressure force to the pressure portion 6*a*. By the pressure force from the pressure portion 6*a*, the heater holding member 6 presses the heater H toward the pressure roller 2.

A recording sheet S to which a toner image has been transferred by the electrophotographic process is fed to the nip portion N, where fed by rotation of the pressure roller unit 2 and the toner image is fixed to the recording sheet by the heat from the heater H via the heat-resistant thin film 5 and the nip pressure.

Next, the recording sheet S attached to the heat-resistant thin film 5 by the toner is stripped from the heat-resistant thin film 5 by a stripping inflection portion 9 and conveyed to the discharge rollers 4. Here, in case the main body stops by a certain cause and the recording sheet S remains in the nip portion N as shown in FIG. 3, if a jam clearance is directly performed, the recording sheet may be broken by the pressure of the nip portion N and the recording sheet may remain in the fixing device to make it difficult to clear the jam.

To cope with this, as shown in FIG. 4, a pressure release lever 43 (43*a*, 43*b*), by operating the pressure release lever 43 (43*a*, 43*b*) as the pressure release member (pressure release means) to the pressure means (pressure applying means) including the compression spring 41 (41*a*, 41*b*) and pressure plate 42 (42*a*, 42*b*) so as to compress the compression spring 41 so that no pressure is applied to the nip portion N and a jam clearance is performed. The pressure release means including the pressure applying means and a lever is arranged at each end of the fixing means in a direction perpendicular to the conveying direction of the recording member.

If the printer main body is operated in this pressure released state, the unfixed image contaminates the heating unit, the pressure roller unit, and the conveying roller, and the ceramic heater is broken.

The pressure release mechanism has configuration as follows. As shown in FIG. 6, by clockwise rotating the pressure release lever 43 provided at the discharge side of the roller supporting member, the cam plate 50 (50*a*, 50*b*) provided on the rotary shaft (not shown) also rotates as a unitary block and the pressure release lever 43 causes the pressure plate 42 to rotate counterclockwise while compressing the compression spring 41. Thus, the pressure force is released.

As for the cam plate, as shown in FIG. 6, a pressure release detection cam follower 44 as a pressure release detection member is rotatably attached, for example, to the roller support member and when the cam plate 50 rotates clockwise which is a pressure release direction, the pressure release detection cam follower 44 rotates clockwise.

The pressure release detection cam follower 44 has at its rotation center, a pressure release detection shaft 44*a*-1 (44*b*-1) extending to the position of the sheet discharge sensor, which is detection means for detecting a presence or absence of a recording material. As shown in FIG. 7, the sheet discharge sensor 60 includes the photo-interrupter 45 and a rocking discharge sense flag 8. In case no sheet is detected as shown in FIG. 7, the optical path of the photo-interrupter 45 is blocked by a light blocking portion 8*a* and when a recording sheet after fixed is discharged and presses a sensor portion 8*b* of the discharge sensor flag 8, the discharge sensor flag 8 rotates clockwise and the light blocking portion 8*a* is retracted from the optical path of the photo-interrupter 45 and output of the photo-interrupter turns ON, indicating that a sheet is being discharged. The sheet discharge sensor 60 is arranged almost at center of the fixing means within the width of the fixing means in a direction perpendicular to the conveying direction of the recording material.

In the embodiment, when the pressure release state is set in, the pressure release detection shaft 44*a*-1 rotates the discharge sensor flag 8 of the sheet discharge sensor 60 clockwise so as to forcibly detect a discharge state (state that a recording material is present). For example, the rocking center of the discharge sensor flag 8 is aligned with the rotation center of the pressure release detection shaft 44*a*-1 (44*b*-1) and a work lever 44*a*-2 (44*b*-2) is attached to the end of the pressure release detection shaft 44*a*-1 (44*b*-1). Moreover, the discharge sensor flag 8 has a workable lever 8*c*, which is brought into abutment with both of the work levers 44*a*-2 and 44*b*-2. That is, the pressure release detection shaft 44*a*-1 (44*b*-1) and the work lever 44*a*-2 (44*b*-2) constitute an engagement member, which is engageable with the workable lever 8*c* constituting a part of a moving member.

Accordingly, when the pressure release detection shaft 44*a*-1 (44*b*-1) rotates in the pressure release direction, rotation of the work lever 44*a*-2 (44*b*-2) of the end of the shaft rotates the discharge sensor flag 8 via the workable lever 8*c*, the photo-interrupter 45 outputs a turned-ON signal (a detection result representing a presence of a recording material).

Next, explanation will be given on the operation performed upon pressure release.

FIG. 5 shows the present embodiment including the pressure release mechanism in the pressure state as viewed from the sheet discharge downstream side. FIG. 6 is a cross sectional view taken on the line VI—VI of FIG. 5. Here, the relationship of the discharge sensor flag 8 of the discharge sensor 60 and the photo-interrupter 45 is as shown in FIG. 7, where a photo-electric portion is blocked from light.

When the pressure release lever 43 is moved in the pressure release direction shown in FIG. 8 to FIG. 11, the pressure release detection cam follower 44, the pressure release detection shaft 44*a*-1 (44*b*-1) and the work lever 44*a*-2 (44*b*-2) operate. Here, as shown in FIG. 11, the discharge sensor flag 8 is pressed by the work lever 44*a*-2 (44*b*-2) and moves from the photo-electric portion of the photo-interrupter 45, which turns ON the photo-interrupter 45.

When the photo-interrupter 45 turns ON, a jam is detected and the printer main body does not operate.

As has been described above, according to the present embodiment, by arranging one set of the pressure release member for one set of the pressure member, i.e., by providing the pressure release lever at each end of the fixing means, it is possible to reduce the operation force of the pressure release lever 43 and to provide the pressure release detection member (pressure release detection cam follower 44, pressure release detection shaft 44*a*-1 (44*b*-1) and the operation lever 44*a*-2 (44*b*-2)) at a comparatively low cost.

Moreover, as a diameter of the pressure release detection shaft 44*a*-1 (44*b*-1) constituting the pressure release detection member can relatively be made thin, it makes it possible to reduce the fixing device in size.

Moreover, the discharge sensor flag 8 can also be reduced in size; there is no danger of deteriorating reliability of operation during the usual conveyance of a recording sheet.

Moreover, since the discharge sensor is arranged substantially at the center of the fixing means within a width of the fixing means, the member related to the discharge sensor need not be large in size and it is possible to reduce the entire apparatus size.

Embodiment 2

Figure 12:
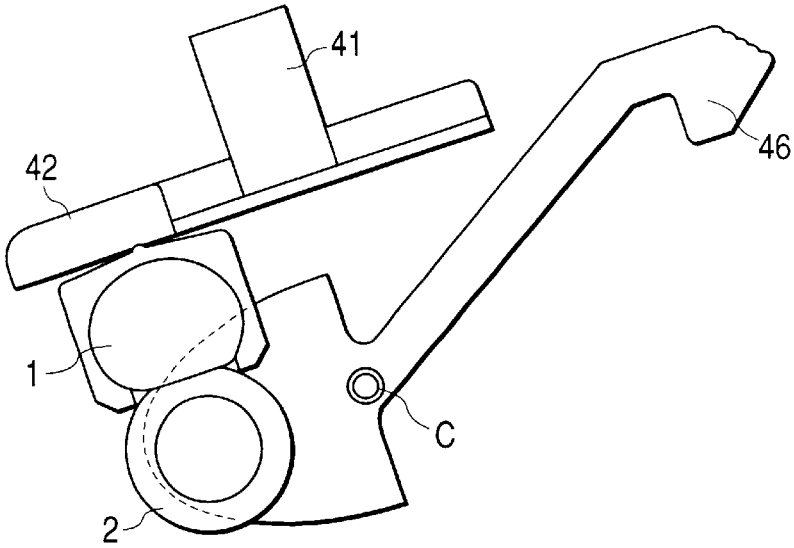
FIG. 12 is a schematic cross sectional view of a pressure release lever portion when pressure is applied in a second embodiment.
Figure 13:
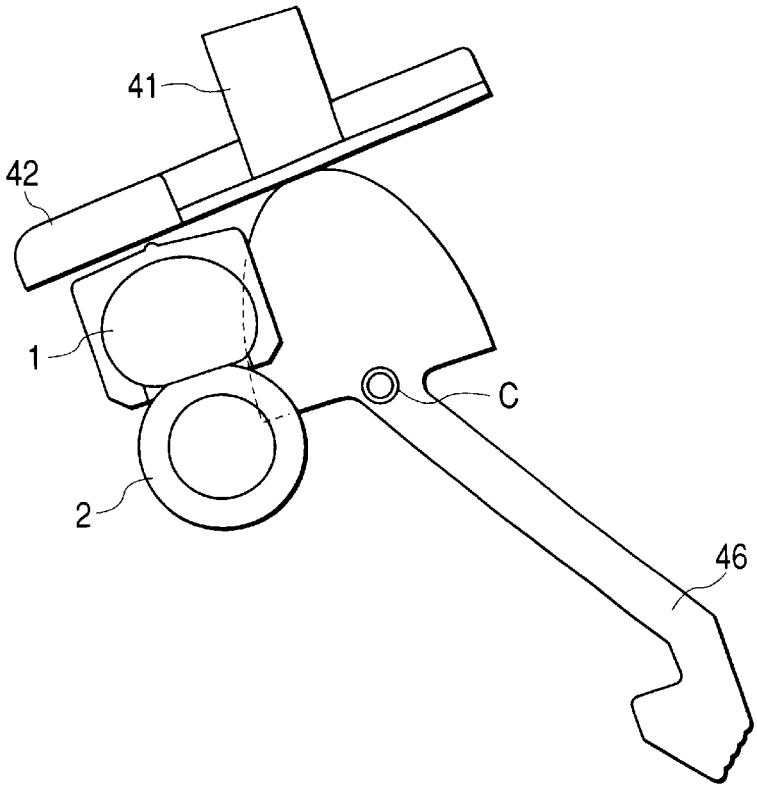
FIG. 13 is a schematic cross sectional view of the pressure release lever portion when pressure is released in the second embodiment.

Next, referring to FIG. 12 and FIG. 13, explanation will be given on a second embodiment of the present invention. FIG. 12 is a schematic cross sectional view of a pressure release portion according to the second embodiment.

The second embodiment has configuration identical to the first embodiment except for that the pressure release lever and the pressure release detection member as the engagement member (pressure release detection cam follower 44 and the pressure release detection shaft 44*a*-1 (44*b*-1) and the work lever 44*a*-2 (44*b*-2)) are formed into one united body as a pressure release and detection lever 46. Accordingly, like components are denoted by like reference symbols and their explanations are partially omitted.

The pressure release and detection lever 46 moves around a rotation center C of the pressure release detection member of the aforementioned embodiment and exhibits the effect like the first embodiment without modifying configurations of the discharge sensors flag and the sheet discharge sensor portion.

As has been described, according to the second embodiment, the pressure release lever and the pressure release detection member are formed into one united body. This enables pressure release detection at a comparatively low cost.

It should be noted that in the aforementioned embodiments, the heating unit uses a heat-resistant thin film but the present invention is not limited to this. The heating unit may be a roller type having a heater arranged at the center portion of the roller.

As has been described above, according to the present invention, it is possible to obtain a configuration of a reduced size at comparatively low cost for surely detecting a pressure release state and inhibit operation of the image forming apparatus main body during pressure release time, thereby preventing contamination of the heating unit, the pressure roller unit, and the conveying roller by unfixed toner and damage of the heater of the heating unit using a ceramic heater.

Moreover, since the pressure means and the pressure release detection member are arranged in a one-to-one relationship, it is possible to eliminate use of a highly rigid expensive shaft member. Thus, it is possible to provide a fixing device and an image forming apparatus of a small size at a reasonable cost.

It is further understood that the present invention is not limited to the aforementioned embodiments but may be modified in various ways without departing from the technical spirit of the present invention.

What is claimed is:

1. An image forming apparatus comprising:

fixing means having a nip portion in which a recording material having an unfixed image is nipped and conveyed so that the unfixed image is fixed to the recording material;

first pressure applying means for applying a pressure to one longitudinal end of said fixing means;

second pressure applying means for applying a pressure to the other longitudinal end of said fixing means;

a first pressure release lever for releasing manually the pressure applied to the one longitudinal end;

a second pressure release lever for releasing manually the pressure applied to the other longitudinal end, wherein each of said first and second pressure release levers is independently movable between a pressure applying position and a pressure releasing position;

detection means for detecting a presence or absence of the recording material, said detection means including a photo-interrupter, and a moving member having a flag acting on said photo-interrupter, wherein said detection means is disposed in a passing area through which the recording material passes, and when the recording material hits against said moving member, said moving member is moved from a recording material absence position to a recording material presence position to detect the presence of the recording material, and when the recording material separates from said moving member, said moving member is restored to the recording material absence position;

a first engagement member for transmitting a force from said first pressure release lever to said moving member, wherein when said first pressure release lever is moved from the pressure applying position to the pressure releasing position, the force is exerted on said moving member through said first engagement member so that said moving member is moved from the recording material absence position to the recording material presence position; and a second engagement member for transmitting a force from said second pressure release lever to said moving member, wherein when said second pressure release lever is moved from the pressure applying position to the pressure releasing position, the force is exerted on said moving member through said second engagement member so that said moving member is moved from the recording material absence position to the recording material presence position.

2. An image forming apparatus according to claim 1, wherein when at least one of said first pressure release lever and said second pressure release lever is positioned in the pressure releasing position, said moving member is not restored to the recording material absence position.

3. An image forming apparatus according to claim 1, wherein said detection means is disposed downstream of the nip portion in a movement direction of the recording material and substantially in a center of the passing area through which the recording material passes.

* * * * *

UNITED STATES PATENT AND TRADEMARK OFFICE

CERTIFICATE OF CORRECTION

PATENT NO. : 6,647,216 B2
DATED : November 11, 2003
INVENTOR(S) : Noriaki Tanaka It is certified that error appears in the above-identified patent and that said Letters Patent is hereby corrected as shown below:

Title page,
Item [57], ABSTRACT,
Line 11, “have” should read -- has --.

Column 2,
Line 22, “have” should read -- has --.

Column 3,
Line 66, “cleaned” should read -- is cleaned --.

Column 5,
Line 22, “after” should read -- after having been --.

Column 6,
Line 11, “member” should read -- members --; and “member,” should read -- members, --.

Signed and Sealed this

Thirtieth Day of March, 2004

JON W. DUDAS
*Acting Director of the United States Patent and Trademark Office*